United States Patent [19]

Rittenbach

[11] 4,378,559

[45] Mar. 29, 1983

[54] RADAR ANTENNA SYSTEM

[75] Inventor: Otto E. Rittenbach, Neptune, N.J.

[73] Assignee: The United States of America as represented by the Secretary of the Army, Washington, D.C.

[21] Appl. No.: 213,436

[22] Filed: Dec. 5, 1980

[51] Int. Cl.[3] ..... H01Q 25/00; H01Q 21/29

[52] U.S. Cl. ..... 343/854; 343/100 SA

[58] Field of Search ..... 343/100 SA, 854, 817, 343/844, 833, 105 R; 367/122, 123

[56] References Cited

U.S. PATENT DOCUMENTS 3,329,897 7/1967 Preble ..... 367/122

3,883,873 5/1975 Mosyakov et al. ..... 343/105 R 3,967,279 6/1976 Zeger ..... 343/100 SA 4,123,759 10/1978 Hines et al. ..... 343/854

*Primary Examiner*—Maynard R. Wilbur

*Assistant Examiner*—K. R. Kaiser

*Attorney, Agent, or Firm*—Nathan Edelberg; Jeremiah G. Murray; Edward Goldberg

[57] ABSTRACT

An antenna beam switching system comprising three antennas whose apertures are disposed in a common plane and which, by means of selective shunting of one or more phase shifters associated with each of the antennas, allows for three dimensional beam switching in at least four directions in space.

3 Claims, 7 Drawing Figures

FIG. 5
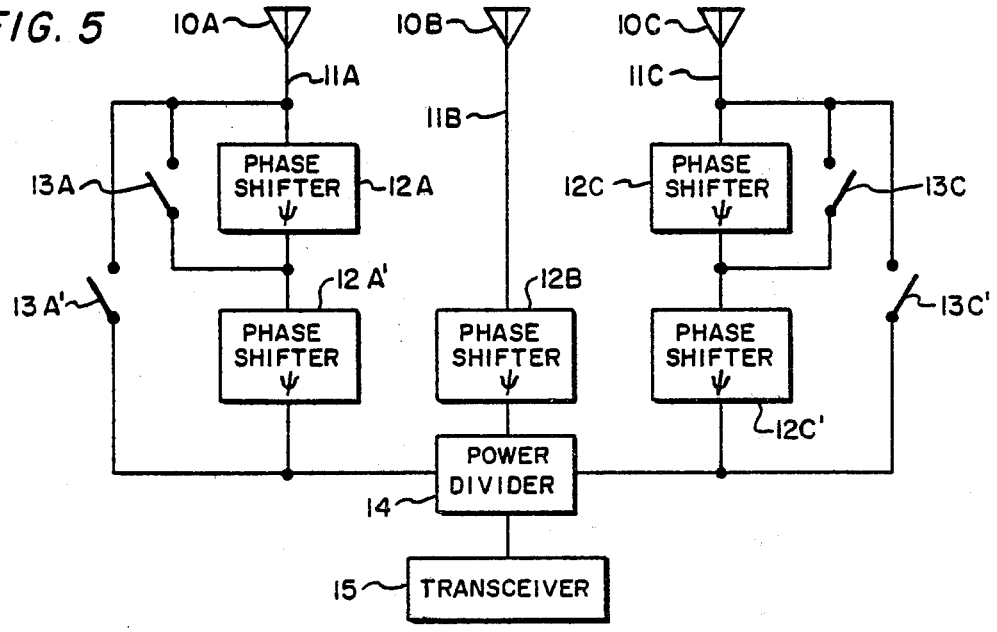
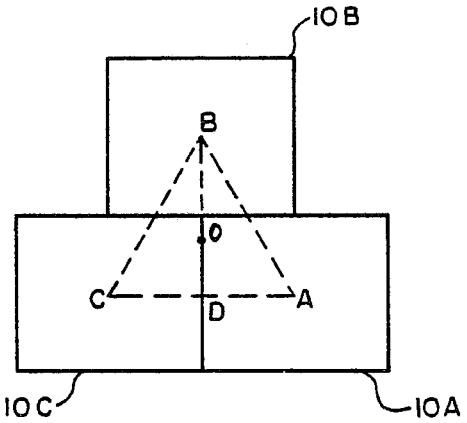
FIG. 6
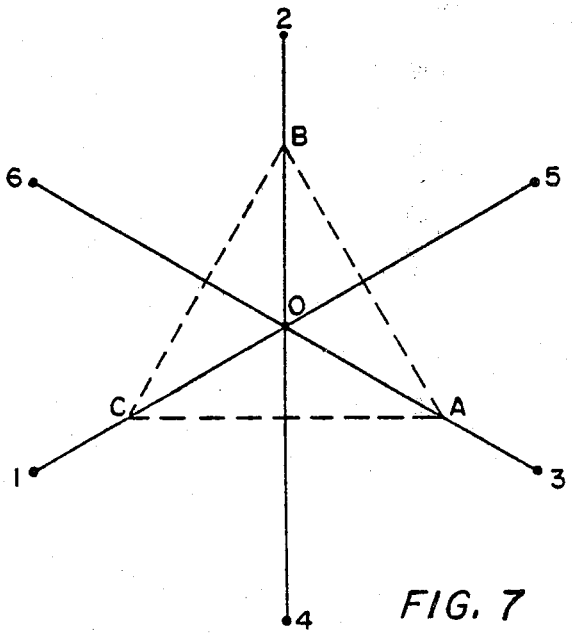
FIG. 7

RADAR ANTENNA SYSTEM

SUMMARY AND BACKGROUND OF THE INVENTION

This invention relates to an improved antenna beam switching system for use with a radar system such as a range-gated, pulse doppler radar system.

My prior patent application, Ser. No. 973,642, entitled "RADAR ANTENNA" filed Dec. 26, 1978 and now issued as U.S. Pat. No. 4,237,464, describes an antenna system comprising two antenna elements wherein the direction of the beam can be switched between two coplanar positions by means of a switch associated with the phase shifting means in one of the antenna element feed lines.

In this application, on the other hand, antenna system embodiments are disclosed which incorporate three antennas each with corresponding phase shifters and which, by means of suitable shunting of at least some of said phase shifters, permits three-dimensional beam switching in at least four different directions in space.

BRIEF DESCRIPTION OF THE DRAWINGS

FIG. 5 is a block diagram illustrating a third embodiment of an antenna beam switching system according to the invention;

FIG. 6 is a diagram showing an arrangement of the antennas in the systems of FIGS. 4 and 5; and FIG. 7 is a diagram illustrating the directional characteristics of the antenna beam for various combinations of switch positions in the systems of FIGS. 4 and 5.

SPECIFIC DESCRIPTION OF INVENTION EMBODIMENTS

Figure 1:
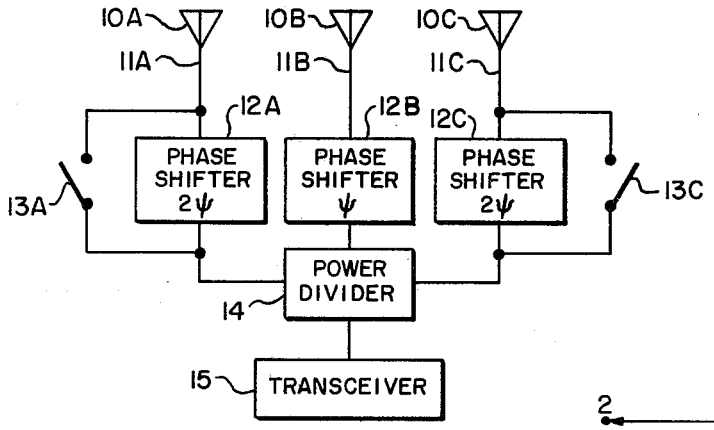
FIG. 1 is a block diagram illustrating a first embodiment of an antenna beam switching system according to the invention.

Referring now to the drawing, a first embodiment of an antenna system is shown in FIG. 1 which comprises three coplanar antenna elements 10A, 10B and 10C which, for example, may be horn antennas with centers at respective points A, B and C. Points A, B and C define a right triangle ABC, as shown in FIG. 2 whose sides AB, BC and CA are of length $\sqrt{2}h$, $\sqrt{2}h$ and 2h, respectively, where h=BD is the altitude of the triangle.

The antennas 10A, 10B and 10C are connected in respective feed lines 11A, 11B and 11C in which are inserted phase shifters 12A, 12B and 12C, all respectively. The feed lines 11A, 11B and 11C are coupled by way of a power divider 14 to a transceiver 15. The phase shifters 12A and 12C can be shunted by closing respective switches 13A and 13C. The phase shifters 12A and 12C introduce twice as much phase shift ($2\varphi$) as the phase shift ($\varphi$) introduced by phase shifter 12B in the feed line 11B of antenna 10B. The phase shift $\varphi$ is given by $\varphi=(2\pi h \sin\alpha/\lambda)$ where $\lambda$ is the operating wavelength and $\alpha$ is the angle of the beam axis relative to the common plane of the antennas.

Figure 2:
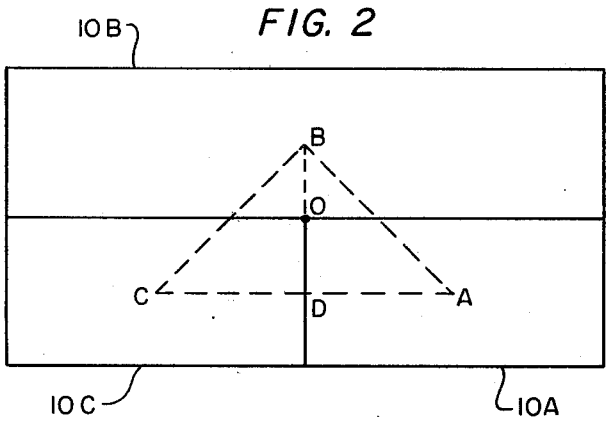
FIG. 2 is a diagram showing an arrangement of the antennas in the system of FIG. 1.

The aperture of antenna 10B, as shown in FIG. 2, is twice that of the apertures of antenna 10A and antenna 10C. Because of this size relationship, the energy in feed line 11B connected to power divider 14 is twice that in feed lines 11A and 11C.

It should be understood that, in certain applications, the antennas are to be used for reception only or for transmission only, in which case a receiver or a transmitter will be used in lieu of the transceiver 15.

Figure 4:
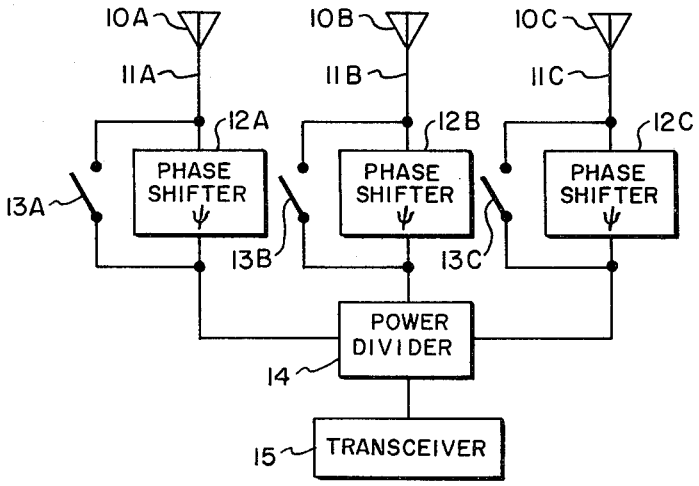
FIG. 4 is a block diagram illustrating a second embodiment of an antenna beam switching system according to the invention.

The phase shifters of FIGS. 1, 4 and 5 may be of the type shown in FIG. 60 at page 12–50 of "Radar Handbook" by Merrill Skolnik, published 1970 by McGraw Hill Book Company.

Figure 3:
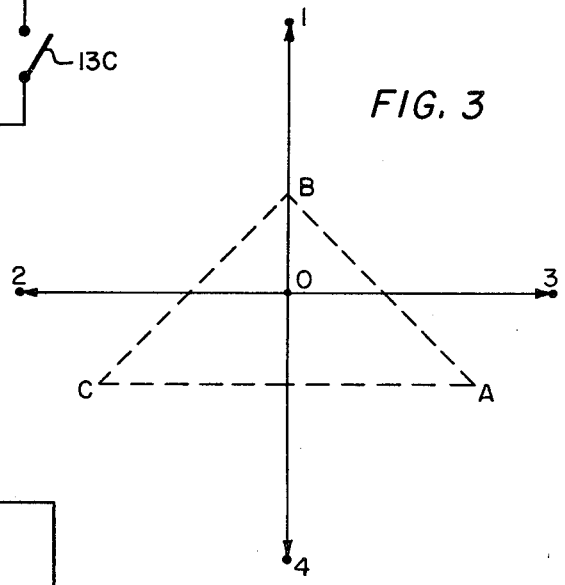
FIG. 3 is a diagram illustrating the directional characteristics of the antenna beam for various combinations of switch positions in the system of FIG. 1.

In FIG. 3 a diagram illustrates the direction of the projection of the axis of the radiation pattern (beam) produced by these antennas acting in concert for different combinations of the switches 13A and 13C listed in Table I. The origin of the beam axis is at the point 0 in FIGS. 2 & 3 and is at a distance h/2=OD from the side AC in FIG. 2.

With the aperture area relationship set forth above, the beam axis 0 is coincident with the center of the combined aperture area of the three antennas.

TABLE I

| Switch Position | | Phase Shift Introduced | | | Beam |
|---|---|---|---|---|---|
| 13A | 13C | Ant 10A | Ant 10B | Ant 10C | Projection |
| Closed | Closed | 0 | $\varphi$ | 0 | 01 |
| Closed | open | 0 | $\varphi$ | $2\varphi$ | 02 |
| Open | closed | $2\varphi$ | $\varphi$ | 0 | 03 |
| Open | Open | $2\varphi$ | $\varphi$ | $2\varphi$ | 04 |

If both switches 13A and 13C are closed, there is zero phase shift in the feed lines to antennas 10A and 10C and a fixed phase shift $\varphi$ is introduced by the phase shifter 12B in the feed-line 11B of antenna 10B. The axis of the composite radiation pattern (beam) has a normalized projection in the common plane of the antenna apertures indicated in FIG. 3 as 01.

If both switches 13A and 13C are open, the phase shift introduced in the feed lines to antennas 10A and 10C is $2\varphi$ and that introduced in the feed line to antenna 10B is $\varphi$. The projection of the axis of the composite radiation pattern in the common plane of the antenna apertures is indicated in FIG. 3 as 04. The origin of the beam axis is at the point 0 in FIG. 3 and is at a distance h/2 from the side AC in FIG. 3.

If one only of the switches 13A and 13C is open, the beam projection is as indicated by 02 or 03 in FIG. 3. See Table I.

Referring now to FIG. 4 wherein elements corresponding to those in FIG. 1 are indicated by like reference characters, an antenna system is shown in which the three antennas 10A, 10B and 10C of equal aperture are centered at corresponding points A, B and C which define an equilateral triangle of altitude h=BD all of whose sides are equal to $2h/\sqrt{3}$ as indicated in FIG. 6.

The phase shifters 12A, 12B and 12C are connected in the corresponding feed lines 11A, 11B and 11C of the respective antennas 10A, 10B and 10C. These antennas are coupled to a common transceiver 15 by way of power divider 14 which permits energy in all feed lines to be equal. Each of the phase shifters 12A, 12B & 12C can be selectively shunted by corresponding switches 13A, 13B and 13C. All of the phase shifters introduce the same phase shift φ where φ is given by the same relationship as set forth in connection with FIG. 1.

Depending upon the position of the switch 13A, 13B and 13C, the axis of the combined beam (radiation pattern) of the antenna system can be pointed in one of seven directions, as shown in FIG. 6. Table II indicates the beam projection on the common plane of the antennas for each of seven combinations of switch positions. The phase shift introduced in the feed lines to antennas 10A, 10B and 10C for each such combination is indicated in Table II.

TABLE II

| Switch Position | | | Phase Shift | | | Beam Projection |
|---|---|---|---|---|---|---|
| Switch 13A | Switch 13B | Switch 13C | Ant 10A | Ant 10B | Ant 10C | |
| closed | closed | closed | 0 | 0 | 0 | 0 |
| closed | closed | open | 0 | 0 | φ | 01 |
| closed | open | closed | 0 | φ | 0 | 02 |
| open | closed | closed | φ | 0 | 0 | 03 |
| open | closed | open | φ | 0 | φ | 04 |
| open | open | closed | φ | φ | 0 | 05 |
| closed | open | open | 0 | φ | φ | 06 |
| open | open | open | 0 | 0 | 0 | 0 |

When all switches are open or closed, the beam direction is the same and is perpendicular to the paper at point 0.

The origin of the beam axis is at the point 0 in FIG. 7 and is at a distance h/3 from the side AC in FIG. 6.

A further antenna system phase shifter arrangement is shown in FIG. 5 and includes two serially connected phase shifters 12A and 12A' in the feed line 11A of antenna 10A, two serially connected phase shifters 12C & 12C' in the feed line 11C of antenna 10C and a single phase shifter 12B in the feed line 11B of antenna 10B. The phase shifters 12A & 12C can be selectively shunted by respective switches 13A & 13C. Both phase shifters 12A and 12A' can both be shunted by switches 13A' and both phase shifters 12C and 12C' can be shunted by switch 13C'. The antennas are centered in a common plane at points defining an equilateral triangle, as indicated in FIG. 6, just as in the system described in FIG. 4. The axis of the composite beam (radiation pattern) of the antenna system can be pointed in any of several directions, as shown in FIG. 7 in which the projection of the beam on the common plane of the antennas is shown by the arrows, except that the origin of the beam axis is at point 0 (which is h/3 distant from the side AC of the triangle) and shown in FIG. 6, the beam emanates from the paper at point 0.

Table III shows the position of the switches, the amount of phase shift in each of the antennas and the beam projection for various beam directions.

TABLE III

| Switch Position | | | | Phase Shift | | | Beam Projection |
|---|---|---|---|---|---|---|---|
| Switch 13A' | Switch 13A | Switch 13C' | Switch 13C | Ant 10A | Ant 10B | Ant 10C | |
| open | closed | open | closed | φ | φ | φ | 0 |
| open | closed | open | open | φ | φ | 2φ | 01 |
| closed | open or closed | closed | closed or open | 0 | φ | 0 | 02 |
| open | open | open | closed | 2φ | φ | φ | 03 |
| open | open | open | open | 2φ | φ | 2φ | 04 |
| open | closed | closed | open or closed | φ | φ | 0 | 05 |
| closed | open or closed | open | closed | 0 | φ | φ | 06 |

The system of FIGS. 1 and 4 can be implemented with two hybrids such as shown in FIG. 60 of the Skolnik handbook, one for each of antennas 10A & 10C. A fixed waveguide phase shifter can be used for antenna 10B.

The system of FIG. 5 can be implemented by two hybrids of the type shown in FIG. 60 of the Skolnik handbook, one for each of phase shifters 12A and 12A' in antennas 10A and one for each of phase shifters 12C and 12C' antenna 10C. Each of the balanced phase bits would have 2 diodes, one of which is selected for a phase shift of φ and the other one selected for a phase shift of 2φ. A waveguide phase shifter can be used for antenna 10B.

I claim:

1. An antenna system comprising:

three antenna elements centered in a common plane at three points defining a right triangle having two equal sides, a plurality of phase shifting means each disposed in respective feed lines between a common transceiver and a corresponding one of said antennas, one of said phase shifting means being fixed, and means for selectively shunting the other two of said phase shifting means to orient the axis of the composite radiation pattern of said antenna system along a selected one of four different three-dimensional positions in space, said other two phase shifting means each including a single phase shifter whose phase shift is twice that of said one phase shifting means.

2. The antenna system according to claim 1 wherein the aperture of the antenna coupled to the fixed phase shifting means is twice that of the apertures of the other two antennas, and wherein said selective shunting means orients said radiation pattern in one of said four positions which are spaced at 90° intervals.

3. The antenna system according to claim 2 further including a power divider for providing twice as much energy in the feed line in which said fixed phase shifting means is disposed as in the feed lines in which the other two of said phase shifting means are disposed.

* * * * *